US005606839A

United States Patent [19]

Baumann

[11] Patent Number: 5,606,839

[45] Date of Patent: Mar. 4, 1997

[54] ENERGY DISSIPATING CONNECTOR

[76] Inventor: Hanns U. Baumann, 312 Emerald Bay, Laguna Beach, Calif. 92651

[21] Appl. No.: 377,643

[22] Filed: Jan. 25, 1995

Related U.S. Application Data

[63] Continuation-in-part of Ser. No. 231,134, Apr. 22, 1994, Pat. No. 5,459,973, which is a continuation-in-part of Ser. No. 893,259, Jun. 3, 1992, Pat. No. 5,305,573.

[51] Int. Cl.[6] ..... E04C 3/26

[52] U.S. Cl. ..... 52/726.1; 52/223.8; 403/305

[58] Field of Search ..... 52/726.1, 726.2, 52/726.3, 743, 223.8; 403/265, 267, 305, 334

[56] References Cited

U.S. PATENT DOCUMENTS

| | | | |
|---|---|---|---|
| 50,190 | 9/1865 | Watson . | |
| 1,238,994 | 9/1917 | Erickson . | |
| 1,253,149 | 1/1918 | Childers . | |
| 3,387,417 | 6/1968 | Howlett | 52/223 |
| 3,638,978 | 2/1972 | Guntermann | 287/108 |
| 3,782,061 | 1/1974 | Minutoli et al. | 52/125 |
| 3,952,468 | 4/1976 | Soum | 52/227 |
| 4,024,688 | 5/1977 | Calini | 52/378 |
| 4,081,219 | 3/1978 | Dykmans | 403/43 |
| 4,095,389 | 6/1978 | Outram et al. | 52/583 |
| 4,424,867 | 1/1984 | Mallow | 52/743 X |
| 4,627,212 | 12/1986 | Yee | 52/726.1 |
| 4,850,777 | 7/1989 | Lawrence et al. | 411/433 |
| 5,308,184 | 5/1994 | Bernard | 503/305 |
| 5,366,672 | 11/1994 | Albrigo et al. | 52/726.1 X |

FOREIGN PATENT DOCUMENTS

| | | | |
|---|---|---|---|
| 2034857 | 6/1980 | United Kingdom | 52/726.1 |

OTHER PUBLICATIONS

"No-Slip Reinforcing Steel Coupler", Promotional Material of Fox-Howlett Industries, Inc. (1 sheet).

"Added Damping and Stiffness Elements For Improving the Earthquake Performance of Structures", by Roger E. Scholl of CounterQuake Corp. (pp. 101–111 and 117).

"Seismic Retrofit With Energy Dissipators", by Egor P. Popov and all, NSF Project Summary of Nov. 1991 (3 Sheets).

"DYWIDAG Threadbar Reinforcing System/Posttensioning System" Promotional Material of DSI DYWIDAG Systems Int'l. (2 Sheets).

*Primary Examiner*—Carl D. Friedman
*Assistant Examiner*—Winnie Yip
*Attorney, Agent, or Firm*—Stetina Brunda & Buyan

[57] ABSTRACT

An energy dissipating connector for coupling first and second rebar members together has a housing for receiving ends of the first and second rebar members, and a viscoelastic material disposed within the housing and interconnecting at least one of the rebar members with the housing. The viscoelastic material facilitates longitudinal movement of the first and second rebar members relative to one another in response to longitudinal tension and compression forces applied to the first and second rebar members.

12 Claims, 3 Drawing Sheets

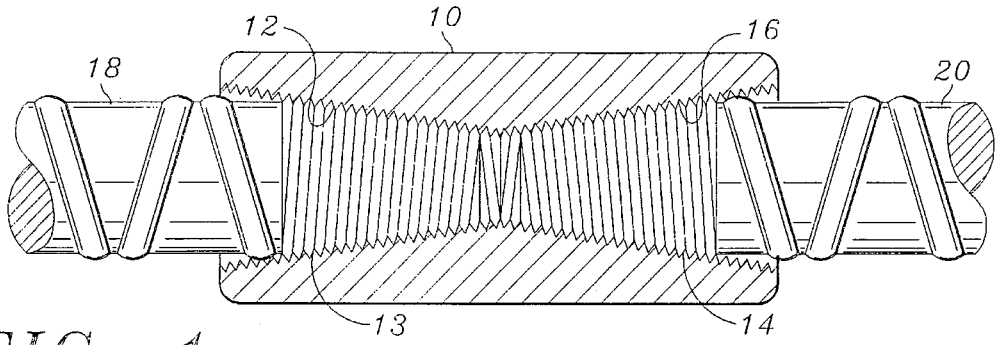
FIG. 1 (PRIOR ART)
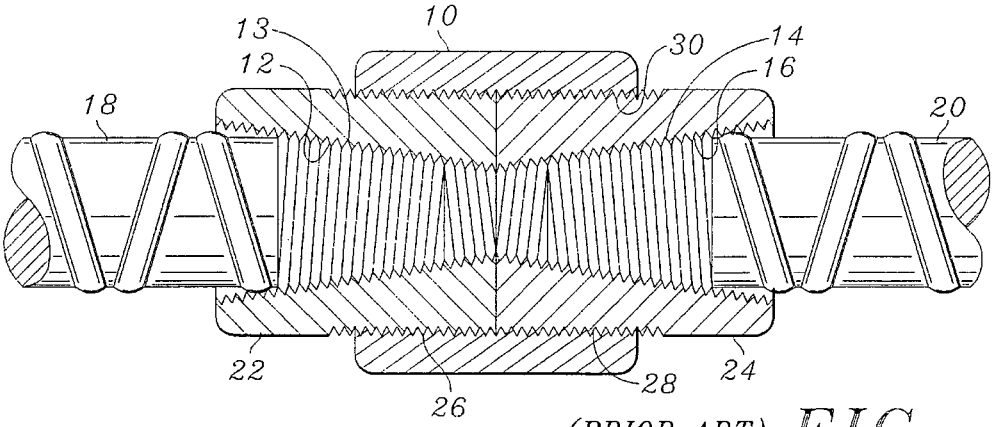
(PRIOR ART) FIG. 2
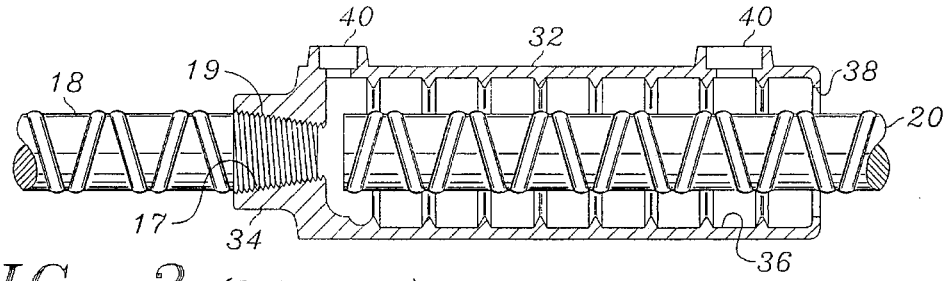
FIG. 3 (PRIOR ART)
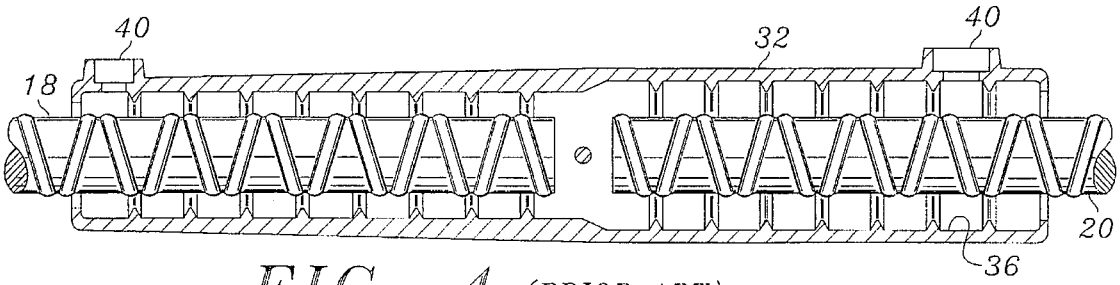
FIG. 4 (PRIOR ART)

ENERGY DISSIPATING CONNECTOR

RELATED APPLICATIONS

This patent application is a continuation-in-part patent application of U.S. Ser. No. 08/231,134, filed Apr. 22, 1994 and entitled ENERGY DISSIPATING CONNECTOR now U.S. Pat. No. 5,459,973, which is a continuation-in-part patent application of U.S. Ser. No. 07/893,259, filed on Jun. 3, 1992 and entitled ENERGY DISSIPATING CONNECTOR (which issued as U.S. Pat. No. 5,305,573 on Apr. 26, 1994), the contents of both of which are hereby incorporated by reference.

FIELD OF THE INVENTION

The present invention relates generally to building construction, and more particularly to an energy dissipating connector for coupling structural members together. The energy dissipating connector utilizes a viscoelastic material to both facilitate relative movement between adjoining structural members and to dissipate the energy causing such movement. The energy dissipating connector of the present invention is thus well suited for earthquake resistant construction.

BACKGROUND OF THE INVENTION

Reinforcing steel couplers or connectors are known for attaching the abutting ends of rebar sections together. Such connectors are commonly utilized to interconnect adjoining precast structural members such as beams and columns in the building construction process. The use of such connectors has been found to be generally preferable to lap splicing wherein the rebar members are positioned such that they overlap and are then welded together or attached to one another by tieing with heavy gage wire.

For example, to attach a horizontal beam to a vertical column, the beam is positioned as desired proximate the column such that first rebar members extending from the beam are almost in abutting relationship with complimentary second rebar members extending from the column. A small gap is present at this time between the first and second rebar members. First and second coupler or attachment members are threaded onto each pair of corresponding first and second rebar members, respectively. The first and second attachment members are threaded on the inside to receive the first and second rebar members and are threaded on the outside to screw into a common or third member.

Next, the third member, comprising a threaded sleeve, is positioned intermediate the first and second attachment members and then rotated such that the first and second attachment members screw thereinto, in a turnbuckle-like fashion. Thus, as the sleeve is rotated, the first and second attachment members, attached to the first and second rebar members, respectively, are drawn together into abutting relationship.

Alternatively, the threaded ends of the first and second rebar members themselves are screwed directly into the sleeve as the sleeve is rotated in a turnbuckle-like fashion. One example of such a coupler is the Lenton Tapered Threaded Splicing System manufactured by Lenton of Erico of Solon, Ohio.

Alternatively, in the prior art a metal filled splice may be utilized to interconnect two rebar members. The ends of each rebar member are received within a common housing and the housing is then filled with molten metal. One example of such a metal filled splice is the Cadweld Splice manufactured by Erico of Solon, Ohio.

As a further alternative in the prior art, the ends of two rebar members may be received within a common housing which is then filled with a cementitious filler, i.e., grout. One example of such a device is the Interlok Splicing System manufactured by Erico of Solon, Ohio.

All such contemporary connectors provide positive mechanical interconnection of the abutting complimentary rebar members. Such interconnection is completely rigid and does not accommodate relative longitudinal motion of the rebar members. Consequently, relative motion of the joined structural members, i.e., beams and/or columns, is likewise not facilitated.

As such, although contemporary reinforcing steel couplers or connectors are generally suitable for their intended purposes, they possess inherent deficiencies which detract from their overall effectiveness in building construction. It is therefore desirable to provide an alternative reinforcing steel coupler or connection which accommodates a degree of longitudinal motion of the abutting rebar members and consequently likewise accommodates a degree of relative movement of the joined structural members, i.e., columns and/or beams. It is further desirable to provide a coupler or connector which dissipates a substantial portion of the energy causing such movement so as to mitigate damage caused by earthquakes and the like.

Summary of the Invention

The present invention specifically addresses and alleviates the above-mentioned deficiencies associated in the prior art. More particularly, the present invention comprises an energy dissipating connector for coupling first and second structural members together. In a first embodiment, the energy dissipating connector has a first attachment member attachable to a first rebar member extending from the first structural member and a second attachment member attachable to a second rebar member extending from the second structural member such that the second attachment member is viscoelastically connected to the first attachment member whereby movement of the second attachment member relative to the first attachment member permits relative motion of the first and second structural members and dissipates the energy causing such motion.

The second attachment member is preferably axially or longitudinally moveable relative to the first attachment member, preferably by approximately ½ inch, i.e., ¼ inch in either direction. The second attachment member preferably moves relative to the first attachment member by its full travel, i.e., ¼ inch in either direction, in response to a force of at least approximately 90,000 pounds.

The first and second attachment members are preferably attachable to the first and second rebar portions via screw threads, preferably tapered or pipe threads.

More particularly, in the first embodiment of the present invention the first and second rebar members are threaded into first and second attachment members, respectively. The first and second attachment members are slidably disposed within a common member or sleeve such that they are substantially constrained to move only axially or longitudinally with respect to one another. A viscoelastic material attaches the first and second attachment members to the interior wall or bore of the sleeve.

The viscoelastic material facilitates movement of the first and second attachment members relative to one another in a manner which absorbs a portion of the energy which causes such movement.

In a second embodiment of the energy dissipating connector of the present invention, the first rebar member is threaded directly to the sleeve and the second rebar member is slidably disposed within the sleeve. A viscoelastic material fills a void intermediate the second rebar member and the inner wall or bore of the sleeve, thereby attaching the second rebar member to the sleeve in a manner which facilitates axial or longitudinal movement of the first and second rebar member relative to one another and in a manner which absorbs a portion of the energy causing such movement.

In a third embodiment of the energy dissipating connector of the present invention, both the first and second rebar members extend into the bore of the sleeve and are both surrounded by a viscoelastic material which connects the first and second rebar members to the sleeve in a manner which facilitates axial or longitudinal movement of the first and second rebar member relative to one another and which absorbs a portion of the energy causing such movement.

In the first embodiment of the present invention, the viscoelastic material is preferably applied to the sleeve so as to attach the first and second attachment members thereto at the factory, such that the first and second attachment members and the sleeve form a single device which is then attached to the threaded ends of the first and second rebar members at a construction site.

Conversely, in the second and third embodiments of the energy dissipating connector of the present invention, the viscoelastic material is formed within the sleeve at the construction site, after the second rebar member (second embodiment) or the first and second rebar members (third embodiment) have been received within the bore of the sleeve.

In the third embodiment of the present invention, the sleeve may be half-filled with viscoelastic material so as to pre-attach the first rebar member thereto at the factory. Only the second rebar member is then inserted into the sleeve at the construction site and the remaining portion of the sleeve is then filled with viscoelastic material.

The viscoelastic material preferably initially comprises a single or multi-component liquid which is poured through one or more ports formed in the sleeve such that it is generally evenly disposed about the rebar member(s). The viscoelastic material then hardens or cures so as to achieve desirable viscoelastic properties which facilitate energy absorption during relative axial or longitudinal movement of the first and second rebar members with respect to one another. Those skilled in the art will appreciate that various different configurations of the sleeve and various different viscoelastic materials are suitable for use in the energy dissipating connector of the present invention.

The viscoelastic material preferably comprises a copolymer having a shear storage modulus of between approximately 1.50 ksi and 2.00 ksi, preferably approximately 1.73 ksi. Various copolymers such as those manufactured by 3M, Uniroyal, and General Electric are suitable for application and the present invention.

The energy dissipating connectors of the present invention are suitable for use in various applications such as the interconnection of precast concrete beams and/or columns. The energy dissipating connectors of the present invention may also be utilized to interconnect steel I-beams, as well as other structural members, as desired.

The energy dissipating connectors of the present invention may be utilized to effect the connection of both steel and concrete members. Further, the energy dissipating connectors of the present invention may alternatively be precast within concrete construction members such that the energy dissipating connectors are pre-attached to the first rebar members and such that the second rebar members, contained within structures to which the precast structural members are to be attached, are readily connectible thereto.

These, as well as other advantages of the present invention will be more apparent from the following description and drawings. It is understood that changes in the specific structure shown and described may be made within the scope of the claims without departing from the spirit of the invention.

BRIEF DESCRIPTION OF THE DRAWINGS

FIG. 1 is a cross-sectional side view of a prior art coupling wherein two rebar members are threaded directly into a sleeve;

FIG. 2 is a cross-sectional side view of a prior art coupling wherein two rebar members are threaded into attachment members which are, in turn, threaded into a sleeve;

FIG. 3 is a cross-sectional side view of a prior art coupling wherein a first rebar member is threaded into a sleeve and a second rebar member is captured within the sleeve via a cementitious or molten metal filler;

FIG. 4 is a cross-sectional side view of a prior art coupling wherein both the first and second rebar members are captured within a sleeve via a cementitious or molten metal filler;

DETAILED DESCRIPTION OF THE PREFERRED EMBODIMENT

Figure 5:
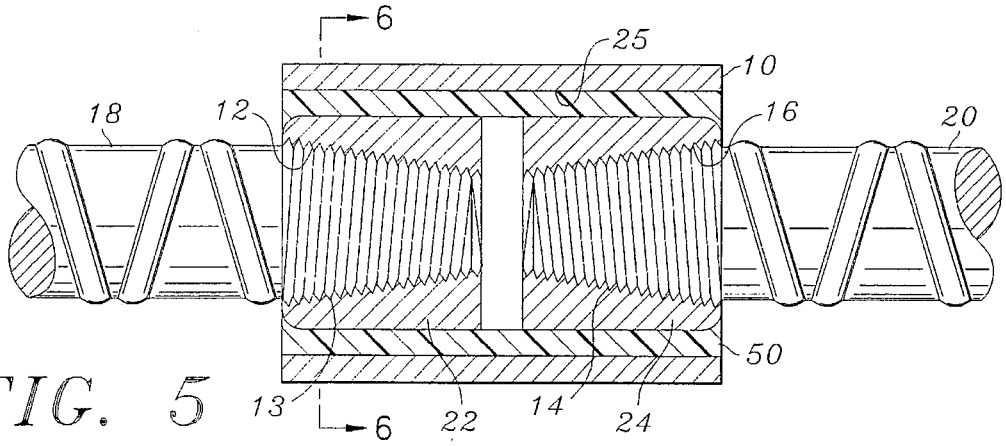
FIG. 5 is a cross-sectional side view of a first embodiment of the energy dissipating connector of the present invention wherein first and second rebar members are threaded into first and second attachment members and the first and second attachment members attached within the bore of a sleeve via a viscoelastic material.

The detailed description set forth below in connection with the appended drawings is intended as a description of the presently preferred embodiment of the invention, and is not intended to represent the only form in which the present invention may be utilized or constructed. The description sets forth the functions and sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

The energy dissipating connector of the present invention is illustrated in FIGS. 5–10 of the drawings which depict three presently preferred embodiments thereof, FIGS. 1–4 depict prior art couplings for attaching first and second rebar members together.

Referring now to FIG. 1, a first prior art coupling comprises a threaded sleeve 10 having first 12 and second 16 tapered or pipe threads formed therein. Complimentary tapered threads 13 and 14 are formed upon a first rebar member 18 and a second rebar member 20, respectively, so as to effect rigid attachment of the first rebar member 18 to the second rebar member 20 when the ends thereof are threaded into the sleeve 10.

One example of such a threaded coupler is the Lenton Tapered Threaded Splicing System as discussed above.

Referring now to FIG. 2, a similar prior art coupling further comprises first 22 and second 24 attachment members, the first attachment member having tapered or pipe threads 12 formed therein and the second attachment member having pipe threads 16 formed therein. The threads 13 and 14 of the first 18 and second 20 rebar members, respectively, engage the threads 12 and 16 of first 22 and second 24 attachment members, respectively.

The first 22 and second 24 attachment members further comprise oppositely threaded outer surfaces 26 and 28, respectively, which engage the threaded bore 30 of the sleeve 10 so as to effect interconnection of the first 18 and second 20 rebar members. Thus, again rigid interconnection of the first 18 and second 20 rebar members is provided.

Referring now to FIGS. 3 and 4, prior art couplings may utilize a cementitious or molten metal filler so as to effect rigid interconnection of the first 18 and second 20 rebar members.

With particular reference to FIG. 3 in one prior art embodiment, the threaded end 19 of the first rebar member 18 engages threads 17 of sleeve 32 via threaded coupling 34 formed upon one end thereof. The second rebar member 20 is received into the bore 36 of the sleeve 32 via opening 38 formed at the opposite end thereof.

After the first rebar member 18 is threaded into threaded coupling 34 and the second rebar member 20 is positioned within the bore 36 of the sleeve 32, then the cementitious or molten metal material is introduced into the bore 36 of the sleeve 32 via ports 40 formed therein. Upon hardening, the cementitious or molten metal material rigidly connects the first 18 and second 20 rebar members to one another.

With particular reference to FIG. 4, in an alternative embodiment of the cementitious material or molten metal filled prior art coupling, both the first 18 and second 20 rebar members are positioned within the bore 36 of the a sleeve 32 and the cementitious or molten metal material is then introduced into the bore 36 via ports 40 as discussed above. Again, the first 18 and second 20 rebar members are rigidly attached to one another via the hardened cementitious or molten metal material.

Thus, in all such prior art devices, the first and second rebar members are rigidly attached to one another such that longitudinal or axial forces are easily propagated from one rebar member to another via the coupling. Such rigid interconnection of the first and second rebar members does not allow for the dissipation of forces causing relative motion between the first and second rebar members. Thus, energy is efficiently transferred from one structural member to another, thereby increasing the potential for damage caused by earthquakes and the like.

Referring now to FIGS. 5–10, according to the present invention a viscoelastic material, preferably a copolymer such as those manufactured by 3M, Uniroyal, and General Electric, facilitates relative movement of the connected rebar members relative to one another. The viscoelastic material is disposed within a sleeve or housing such that axial or longitudinal forces present in one rebar member must be transmitted as a shear force through the viscoelastic material in order to transfer the axial or longitudinal force to the other rebar member.

In applying such a force to the viscoelastic material, a substantial portion of the force is dissipated by the viscoelastic material, rather than transmitted to the other rebar member. Thus, the energy dissipating connector of the present invention functions to attenuate or reduce the intensity of such axial or longitudinal forces, rather than transmitting such forces essentially undiminished, as in the prior art.

As those skilled in the art will appreciate, the attenuation of such axial or longitudinal forces facilitates the fabrication of building structures which are capable of withstanding greater transient loads, such as those caused by earthquakes and high winds.

Figure 6:
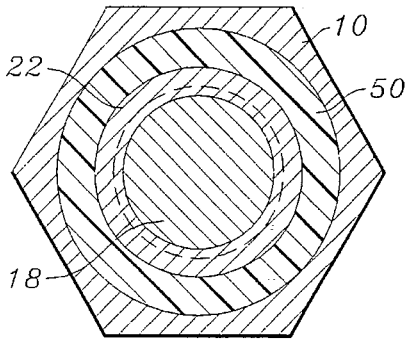
FIG. 6 is a cross-sectional side view of the energy dissipating connector of FIG. 5.

With particular reference to FIGS. 5 and 6, the first embodiment of the present invention comprises first 22 and second 24 attachment members having oppositely threaded first 12 and second 16 tapered or pipe threads formed herein. The first 22 and second 24 attachment members engage the threaded ends 13 and 14 of the first 18 and second 20 rebar members, respectively. The first 22 and second 24 attachment members are disposed within the bore 25 of the housing or sleeve 10.

A layer of viscoelastic material 50 is formed intermediate each of the first 22 and second 24 attachment members and the sleeve 10, within the bore 25 thereof.

As will be appreciated, when either rebar member 18 or 20 is subjected to a force, which either places that rebar member 18 or 20 in a compression or tension with respect to the other rebar member 20 or 18, that force must be transmitted, in a shear mode through the viscoelastic material 50 so as to be applied to the other rebar member 20 or 18. The application of such a shear force to the viscoelastic material 50 results in the dissipation of a substantial portion of such force.

As shown in FIG. 6, the sleeve 10 is preferably configured as a nut, preferably a hex nut, so as to facilitate tightening thereof, e.g., utilizing a wrench. Alternatively, the sleeve 10 may merely have one or more flats formed thereto to facilitate turning thereof with a tool.

The first 22 and second 24 attachment members are preferably formed to the sleeve 10 via the viscoelastic material 50 at the factory, such that a one-piece assembly is provided for the interconnection of each pair of rebar members.

Figure 7:
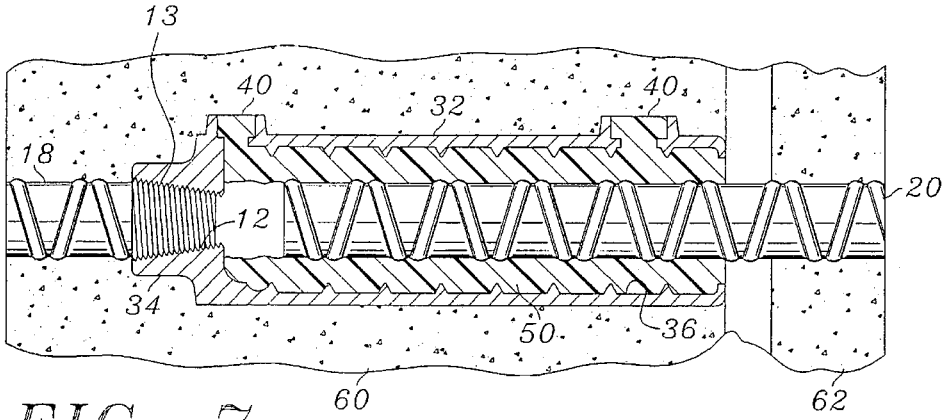
FIG. 7 is a cross-sectional side view of a second embodiment of the energy dissipating connector of the present invention wherein a first rebar member threads into a sleeve and a second rebar member is received within the bore of the sleeve and attached to the sleeve via a viscoelastic material.

Referring now to FIG. 7, the second embodiment of the energy dissipating connector of the present invention comprises a threaded coupling 34 having threads 12 formed upon one end of a housing or sleeve 32 which facilitates attachment of the sleeve 32 to the threads 13 of the first rebar member 18.

The end of a second rebar 20 is disposed within a bore 36 of the sleeve 32. A viscoelastic material 50 is disposed intermediate the sleeve 32 and the second rebar member 20, thereby resiliently attaching the first 18 and second 20 rebar members to one another. The viscoelastic material 50 is typically applied via ports 40 at the construction site after insertion of the second rebar member 20 into the bore 36 of the sleeve 32. Optionally, the first rebar member 18 may be attached to the housing or sleeve 32 at a location other than the construction site via the threaded coupling 34, as illustrated, or via alternative means such as welding.

As shown in FIG. 7, the second embodiment of the energy dissipating connector of the present invention is disposed within a first concrete construction member, e.g., a beam 60, along with the first rebar member 18 and the second 20 is similarly disposed within a second concrete construction member 62. Thus, the first 60 and second 62 concrete construction members are attached to one another in a manner which facilitates the dissipation of energy when the two construction members 60 and 62 move with respect to one another.

Figure 8:
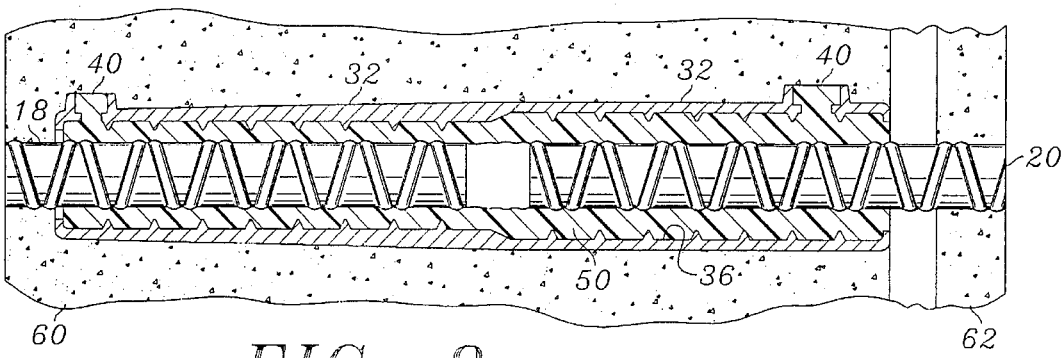
FIG. 8 is a cross-sectional side view of a third embodiment of the energy dissipating connector of the present invention wherein both the first and second rebar members are received within the bore of a sleeve and are attached to the sleeve via a viscoelastic material.

With particular reference to FIG. 8, in the third embodiment of the present invention, both the first 18 and second 20 rebar members are disposed within the bore 36 of a housing or sleeve 32 in a manner analogous to that of the second rebar member 20 of the second embodiment of the present invention (FIG. 7). Thus, rather than requiring that the end of the first rebar member 18 be threaded, the first rebar member 18 is merely inserted into the sleeve 32 prior to applying the viscoelastic material 50 via ports 40.

Optionally, the first rebar member 18 may be positioned within the bore 36 of the sleeve 32 and viscoelastic material applied intermediate the first rebar member 18 and the sleeve 32 so as to facilitate attachment of the first rebar member 18 to the sleeve 32, at the factory or some other site remote to the construction site. The second rebar member 20 is then subsequently inserted into the bore 36 of the sleeve 32 at the construction site and additional viscoelastic material 50 applied to the sleeve 32 so as to facilitate attachment of the first 18 and second 20 rebar members. Thus, again, the first 60 and second 62 concrete construction members are attached to one another in a manner which facilitates the dissipation of energy when the two construction members 60 and 62 move with respect to one another.

Figure 9:
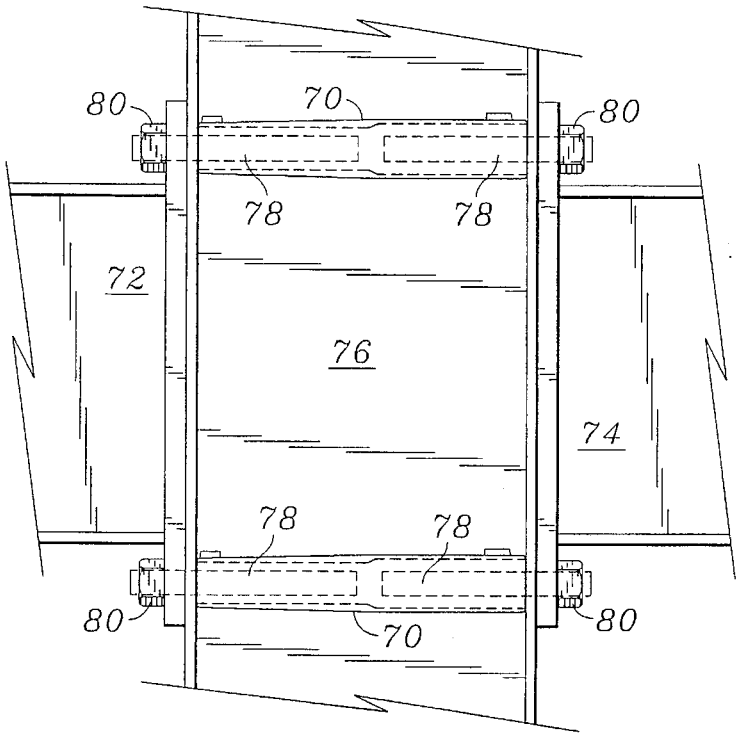
FIG. 9 and 10 are orthogonal views illustrating the use of the present invention to interconnect to steel I-beams.
Figure 10:
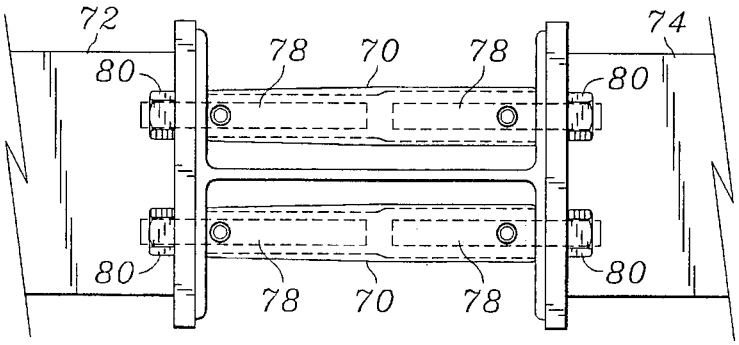

Referring now to FIGS. 9 and 10, the energy dissipating connector of the present invention may be utilized to interconnect various structural members to one another in a manner which facilitates energy dissipation as axial or longitudinal forces are transmitted therebetween.

For example, an energy dissipating connector 70 of the third embodiment of the present invention may be utilized to interconnect first 72 and second 74 steel I-beams to one another. A spacer 76 is disposed intermediate the first 72 and second 74 I-beams and four energy dissipating connectors 70 are used to attached the first 72 and second 74 I-beams to one another. The ends of the rebar members 78 extending from the energy dissipating connectors 70 are threaded and nuts 80 are threaded onto the ends of the rebar members 78. Thus, the first 72 and second 74 steel I-beams are resiliently attached to one another so as to facilitate the dissipation of axial or longitudinal forces being transmitted therethrough.

It is understood that the exemplary energy dissipating connectors described herein and shown in the drawings represent only a presently preferred embodiment of the invention. Indeed, various modifications and additions may be made to such embodiment without departing from the spirit and scope of the invention. For example, the housing may be of various configurations other than that described and illustrated. Indeed, the housing need not be configured as a sleeve, but rather may alternatively comprise various different structures wherein a resilient material is utilized to interconnect first and second structural members. Thus, these and other modifications and additions may be obvious to those skilled in the art and may be implemented to adapt the present invention for use in a variety of different applications.

What is claimed is:

1. An energy dissipating connector for coupling first and second rebar members together, said connector comprising:

a) a housing for receiving ends of the first and second rebar members;

b) a viscoelastic material disposed within said housing and interconnecting at least one of said rebar members with said housing; and c) wherein said visoelastic material facilitates longitudinal movement of the first and second rebar members relative to one another in response to longitudinal tension and compression forces applied to said first and second rebar members.

2. The energy dissipating connector as recited in claim 1 wherein said viscoelastic material generally surrounds a portion of at least one of said rebar members.

3. The energy dissipating connector as recited in claim 1 wherein said viscoelastic material comprises a copolymer.

4. The energy dissipating connector as recited in claim 1 herein said viscoelastic material comprises a copolymer having a shear storage modulus between approximately 1.50 and 2.00 ksi.

5. The energy dissipating connector as recited in claim 1 wherein said viscoelastic material comprises a copolymer having a shear storage modulus of approximately 1.73 ksi.

6. The energy dissipating connector as recited in claim 1 wherein said housing comprises a threaded coupling for engaging one of said first and second rebar members.

7. The energy dissipating connector as recited in claim 1 wherein said housing comprises at least one port for facilitating the introduction of said viscoelastic material thereinto.

8. An energy dissipating connector for coupling first and second rebar members together, said connector comprising:

a) a housing having a threaded coupling formed thereon to facilitate attachment of the housing to said first rebar member, said housing having a bore formed therethrough;

b) a viscoelastic material disposed within said bore so as to interconnect said housing and said second rebar member; and c) at least one port formed in said housing for introducing said viscoelastic material into said bore.

9. An energy dissipating connector for coupling first and second rebar members together, said connector comprising:

a) a housing having a bore formed therethrough, said bore configured to receive ends of said first and second rebar members;

b) a viscoelastic material disposed within said bore; and c) at least one port formed in said housing for introducing said viscoelastic material into said bore.

10. A method for coupling first and second rebar members together, said method comprising:

a) engaging the first rebar member with a threaded coupling formed upon a housing having a bore formed therein;

b) inserting the second rebar member into the bore of said housing; and c) introducing a viscoelastic material into the bore of said housing.

11. A method for coupling first and second rebar members together, said method comprising:

a) inserting first and second rebar members into a bore formed in a housing;

b) introducing a viscoelastic material into the bore of said housing; and c) wherein said viscoelastic material facilitates longitudinal movement of the first and second rebar members relative to one another in response to longitudinal tension and compression forces applied to said first and second rebar members.

12. A structural member comprising:

a) a precast first concrete member;

b) an energy dissipating connector precast at least partially within said first concrete member, said energy dissipating connector comprising:

(i) a housing receiving an end of a first rebar member which extends substantially through said first concrete member and also receiving an end of a second rebar member which extends substantially through a second concrete member;

(ii) a viscoelastic material disposed within said housing and interconnecting at least one of said rebar members with said housing;

c) wherein said viscoelastic material facilitates movement of said first and second concrete members with respect to one another in response to tension and compression forces applied to said first and second rebar members.

* * * * *